US011317229B1

(12) United States Patent
Chen

(10) Patent No.: US 11,317,229 B1
(45) Date of Patent: Apr. 26, 2022

(54) LOUDSPEAKER HAVING DAMPER WITH WOVEN WIRE AND METHOD FOR MANUFACTURING THE SAME

(71) Applicant: Vincent Chen, Taipei (TW)

(72) Inventor: Vincent Chen, Taipei (TW)

( * ) Notice: Subject to any disclaimer, the term of this patent is extended or adjusted under 35 U.S.C. 154(b) by 0 days.

(21) Appl. No.: 17/120,301

(22) Filed: Dec. 14, 2020

(51) Int. Cl.

| | |
|---|---|
| ***H04R 31/00*** | (2006.01) |
| ***D03D 1/00*** | (2006.01) |
| ***D06N 3/00*** | (2006.01) |
| ***H04R 9/04*** | (2006.01) |

(52) U.S. Cl.
CPC ..... *H04R 31/003* (2013.01); *D03D 1/00* (2013.01); *D06N 3/0006* (2013.01); *H04R 9/046* (2013.01); *H04R 2307/201* (2013.01)

(58) Field of Classification Search
CPC ..... H04R 9/043
See application file for complete search history.

(56) References Cited

U.S. PATENT DOCUMENTS

2002/0034315 A1* 3/2002 Auerbach ..... H04R 9/06 381/403

* cited by examiner

*Primary Examiner* — Mark Fischer
(74) *Attorney, Agent, or Firm* — Lin & Associates Intellectual Property, Inc.

(57) ABSTRACT

A method for manufacturing a loudspeaker includes arranging, weaving, impregnating, drying, forming, cutting and assembling steps. In the arranging step, warp yarns and wires are arranged at intervals, and the wires are grouped as a wire group. In the weaving step, weft yarns are arranged at intervals and interwoven with the warp yarns and the wires to form a base material by weaving, and an area where the weft yarns are interwoven with the wires is defined as a wire disposing area. In the forming step, a wire damper is formed on the base material by thermoforming; two elastic adjustment areas are formed at the weft yarns between both sides of the wire group and the warp yarns closest to both sides of the wire group; and widths of the elastic adjustment areas are equal to each other and larger than distances between the remaining warp yarns.

4 Claims, 20 Drawing Sheets

LOUDSPEAKER HAVING DAMPER WITH WOVEN WIRE AND METHOD FOR MANUFACTURING THE SAME

BACKGROUND OF THE INVENTION

1. Field of the Invention

The present invention relates to a loudspeaker and a method for manufacturing the same, and more particularly, to a loudspeaker having a damper with woven wires and a method for manufacturing the same.

2. The Prior Arts

In the general moving coil loudspeaker, the principle that the reaction force of a fixed magnetic field causes another magnetic field to move in the opposite direction (i.e., opposite magnetisms attract each other, and like magnetisms repels each other) is used to produce sound. Further, the power alternating current generated by the power amplifier is transmitted to the voice coil through a wire to change the polarity of the magnetic field, such that the voice coil generates a reaction force against the fixed magnetic region generated by the magnetic circuit device. The forward pulse causes the diaphragm move outward relative to the magnet, while the backward pulse causes the diaphragm move inward. When the voice coil pushes the diaphragm to reciprocate, the diaphragm pushes air, and the air pressure changes to form sound waves. The damper is responsible for maintaining the correct position of the voice coil in the gap of the magnet core, ensuring that the voice coil reciprocates along the axis direction when being forced.

However, in the conventional loudspeaker, the wire is suspended in the air without any support, so that the wire alone bears the vibration force transmitted from the voice coil. Thereby, after the voice coil moves rapidly and frequently for a period of time, the wire is easy to fatigue and be broken.

In order to solve the above problems, in this industry, it has begun to develop the process of fixing the wires on the damper during the manufacturing procedure of the wire damper to manufacture a wire damper. By using the main body of the wire damper to support the wire, the wire has an increased fatigue resistance and becomes not easy to be broken. Hereinafter, two methods for manufacturing wire dampers are introduced.

The first method for manufacturing wire damper includes the following steps: first, a base material being a single-layer fabric structure is prepared; then, the base material is impregnated in a liquid synthetic resin to absorb the synthetic resin; next, the base material absorbing the synthetic resin is dried and hardened; afterward, the wire is sewed and fixed on the surface of the base material by a sewing thread; subsequently, a wire damper is formed from the base material and a wire by the thermal pressurization of a thermoforming device; and finally, the wire damper is cut from the base material by a cutting device. By using the main body of the wire damper to support the wire, the wire has an increased fatigue resistance and becomes not easy to be broken.

The second method for manufacturing wire damper includes the following steps: first, a base material, which is a double-layer fabric structure and includes a first fabric and a second fabric, is prepared; then, the first and second fabrics are impregnated in a liquid synthetic resin to absorb the synthetic resin; next, the first and second fabrics absorbing the synthetic resin are dried and hardened; afterward, a wire is disposed between the first and second fabrics; afterward, the wire is fixed between the first and second fabrics by the thermal pressurization of a thermoforming device, thereby forming a wire damper; and finally, the wire damper is cut from the base material by a cutting device.

The individual problem of the first method for manufacturing wire damper is that: a manual operation of a sewing machine is required to sew and fix the wire on the surface of the base material by the sewing thread.

The individual problems of the second method for manufacturing wire damper are that: first, in the thermoforming process, the position of the wire will shift away from the optimal position, thereby affecting the common resonance efficiency of the wire damper, the voice coil, and the diaphragm; second, the shifting condition of the position of the wire of each wire damper is different from others, such that the sound quality of each loudspeaker is slightly different from others.

The above two methods for manufacturing wire dampers have several common problems as follows.

First, the steps are complicated.

Then, the wire is harder than the warp yarns and the weft yarns, and the elasticity and toughness of the wire are worse than those of the warp yarns and the weft yarns, such that the wire disposing area is harder than other areas of the wire damper, and the elasticity and toughness of the wire disposing area are worse than those of other areas of the wire damper. Therefore, the hardness, elasticity, and toughness of the wire damper are non-uniform, resulting in non-uniform elastic resilience and fatigue resistance of the wire damper, which causes the wire damper to be easy to be deformed, thereby affecting the output sound quality of the loudspeaker.

In addition, there are two common types of wires. The first type of wire is formed by blend-twisting a plurality of fine wires and has a circular cross-section. The second type of wire is a flat wire formed by interweaving a plurality of fine wires and has a flat cross-section. The fine wires of the two common wires are both tightly close to each other, which causes the heat generated by each fine wire to be difficult to dissipate and results in problems of heat accumulation, thereby causing the wires easily to be overheated.

Furthermore, the entire wire is tightly close to the yarn and is confined by the yarn, thereby cannot flex freely.

SUMMARY OF THE INVENTION

The main objective of the present invention is to provide a loudspeaker having a damper with woven wires and a method for manufacturing the same, which utilize the weft yarns to fix the wires, such that no sewing thread is required at all, the manufacturing steps are reduced, and the plurality of wires can be firmly fixed at the optimal position without shifting, thereby improving the common resonance efficiency of the wire damper, the voice coil and the diaphragm, and the sound quality of each loudspeaker can be kept consistent.

Another objective of the present invention is to provide a loudspeaker having a damper with woven wires and a method for manufacturing the same, wherein the wire damper has uniform hardness, elasticity and toughness, thereby having uniform elastic resilience and fatigue resistance, and being not easy to be deformed and brittle, which improves the output sound quality of the loudspeaker.

In order to achieve the above objectives, the present invention provides a method for manufacturing a loudspeaker having a damper with woven wires, including: an arranging step, a weaving step, an impregnating step, a drying step, a forming step, a cutting step and an assembling step.

In the arranging step, a plurality of warp yarns and a plurality of wires are arranged at intervals, the warp yarns and the wires extend straight and are parallel to each other, each of the wires is a monofilament wire, the wires are grouped as at least one wire group, and both sides of the at least one wire group are respectively defined as a first side and a second side.

In the weaving step, a plurality of weft yarns are arranged at intervals and interwoven with the warp yarns and the wires to form a base material by weaving, the weft yarns extend straight and are perpendicular to the warp yarns and the wires, and an area where the weft yarns are interwoven with the wires is defined as a wire disposing area.

In the impregnating step, the base material is impregnated in a resin solution.

In the drying step, the base material is dried to form a solid resin layer on the base material.

In the forming step, a wire damper is formed on the base material by thermoforming, the wire damper includes the warp yarns, the wires and the weft yarns, and the solid resin layer is formed on a surface of the wire damper; an elastic adjustment area is formed at the weft yarns between the first side of the at least one wire group and the warp yarn closest to the first side of the at least one wire group; another elastic adjustment area is formed at the weft yarns between the second side of the at least one wire group and the warp yarn closest to the second side of the at least one wire group; and widths of the elastic adjustment areas are equal to each other, and distances between the remaining warp yarns are less than the width of each of the elastic adjustment areas.

In the cutting step, the wire damper is cut from the base material.

In the assembling step, a voice coil is movably disposed in a loudspeaker body, the wire damper is sleeved at the voice coil, and the at least one wire group is connected to the voice coil to assemble the loudspeaker.

In order to achieve the above objectives, the present invention provides a loudspeaker having a damper with woven wires, including a loudspeaker body, a voice coil and a wire damper. The voice coil is movably disposed in the loudspeaker body. The wire damper is sleeved at the voice coil and includes a plurality of warp yarns, a plurality of wires and a plurality of weft yarns. A solid resin layer is formed on a surface of the wire damper. The warp yarns and the wires are arranged at intervals. The warp yarns and the wires extend straight and are parallel to each other. Each of the wires is a monofilament wire. The wires are grouped as at least one wire group. Both sides of the at least one wire group are respectively defined as a first side and a second side. The weft yarns are arranged at intervals and interwoven with the warp yarns and the wires. The weft yarns extend straight and are perpendicular to the warp yarns and the wires. An area where the weft yarns are interwoven with the wires is defined as a wire disposing area. An elastic adjustment area is formed at the weft yarns between the first side of the at least one wire group and the warp yarn closest to the first side of the at least one wire group. Another elastic adjustment area is formed at the weft yarns between the second side of the at least one wire group and the warp yarn closest to the second side of the at least one wire group. The widths of the elastic adjustment areas are equal to each other. The distances between the remaining warp yarns are less than the width of each of the elastic adjustment areas. The at least one wire group is connected to the voice coil.

The effects of the present invention are that: by utilizing the weft yarns to fix the wires, no sewing thread is required at all, the manufacturing steps are reduced, and the wires can be firmly fixed at the optimal position without shifting, which improves the common resonance efficiency of the wire damper, the voice coil and the diaphragm, and the sound quality of each loudspeaker can be kept consistent.

Furthermore, by the elastic adjustment areas, the hardness, elasticity and toughness of the wire disposing area can be adjusted. Therefore, the wire disposing area becomes softer, and its elasticity and toughness are increased. Thereby, the hardness, elasticity, and toughness of the combination of the wire disposing area and the wires are equivalent to those of other areas of the wire damper. Therefore, the wire damper has uniform hardness, elasticity and toughness, thereby having uniform elastic resilience and fatigue resistance, and being not easy to be deformed and brittle, which improves the output sound quality of the loudspeaker.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Herein after, a more detailed description of the implementation of the present invention with reference to the drawings and reference symbols, such that those skilled in the art can implement it after studying this written description.

Referring to FIGS. 1 to 4, the present invention provides a method for manufacturing a loudspeaker having a damper with woven wires, including: an arranging step S1, a weaving step S2, an impregnating step S3, a drying step S4, a forming step S5, a cutting step S6, and an assembling step S7.

Figure 1:
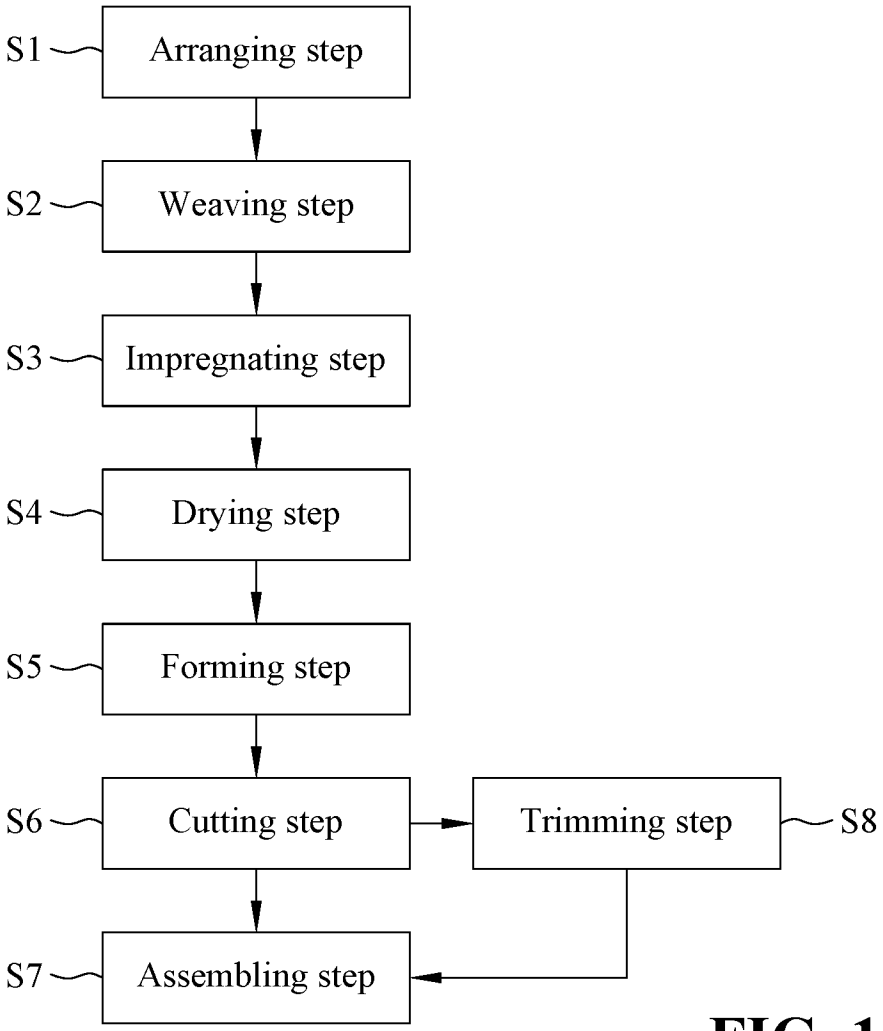
FIG. 1 is a block flow diagram of the method of the present invention.
Figure 2:
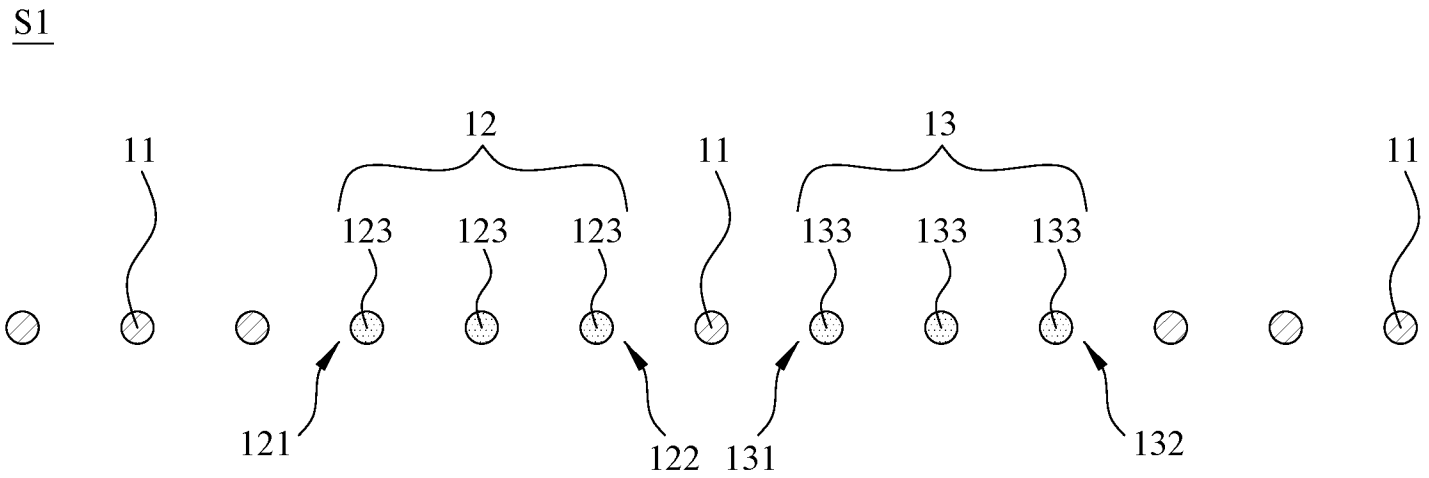
FIG. 2 is a schematic view of the arranging step of the first embodiment of the method of the present invention.

In the arranging step S1, as shown in FIGS. 1 and 2, a plurality of warp yarns 11, a plurality of first wires 123 and a plurality of second wires 133 are arranged at intervals. The warp yarns 11, the first wires 123 and the second wires 133 extend straight and are parallel to each other. Each first wire 123 and each second wire 133 are both monofilament wires. The first wires 123 are arranged side by side and grouped as a first wire group 12, and both sides of the first wire group 12 are respectively defined as a first side 121 and a second side 122. The second wires 133 are arranged side by side and grouped as a second wire group 13, and both sides of the second wire group 13 are respectively defined as a first side 131 and a second side 132. At least one warp yarn 11 is arranged between the second side 122 of the first wire group 12 and the first side 131 of the second wire group 13.

Figure 3:
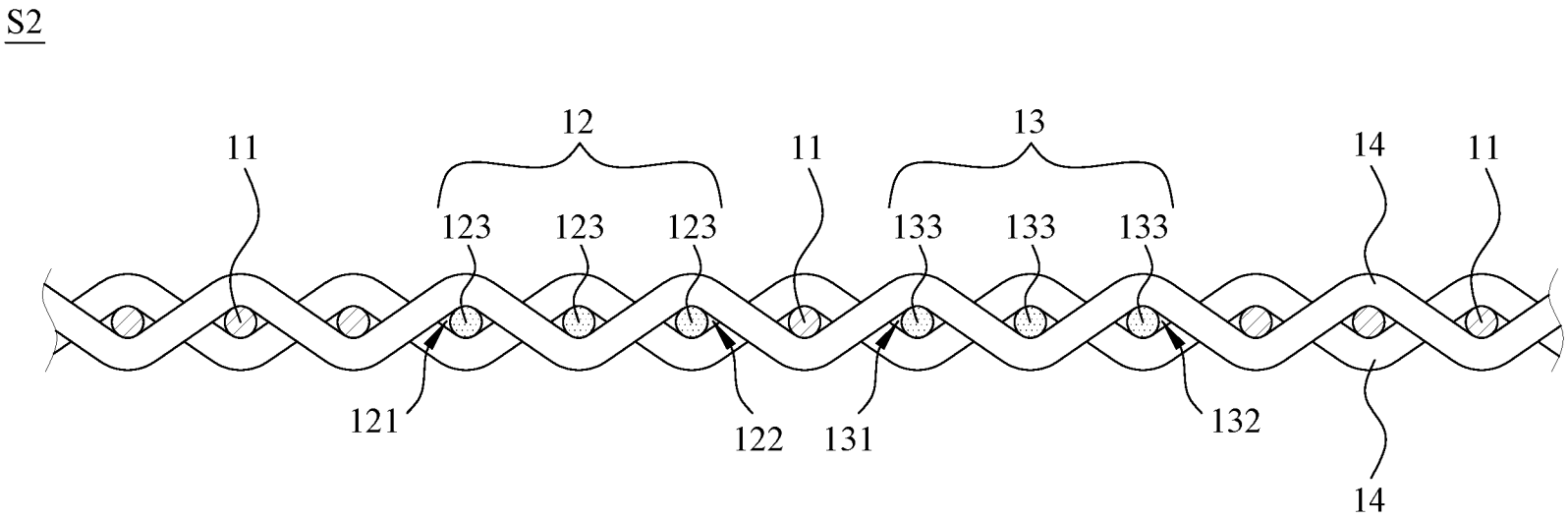
FIG. 3 is a schematic view of the weaving step of the first embodiment of the method of the present invention.

In the weaving step S2, as shown in FIGS. 1 and 3, a plurality of weft yarns 14 are arranged at intervals and interwoven with the warp yarns 11, the first wires 123 and the second wires 133, so as to form a base material 10 by weaving. The weft yarns 14 extend straight and are perpendicular to the warp yarns 11, the first wires 123 and the second wires 133. The area where the weft yarns 14 are interwoven with the first wires 123 is defined as a first wire disposing area 15. The area where the weft yarns 14 are interwoven with the second wires 133 is defined as a second wire disposing area 16.

Figure 4:
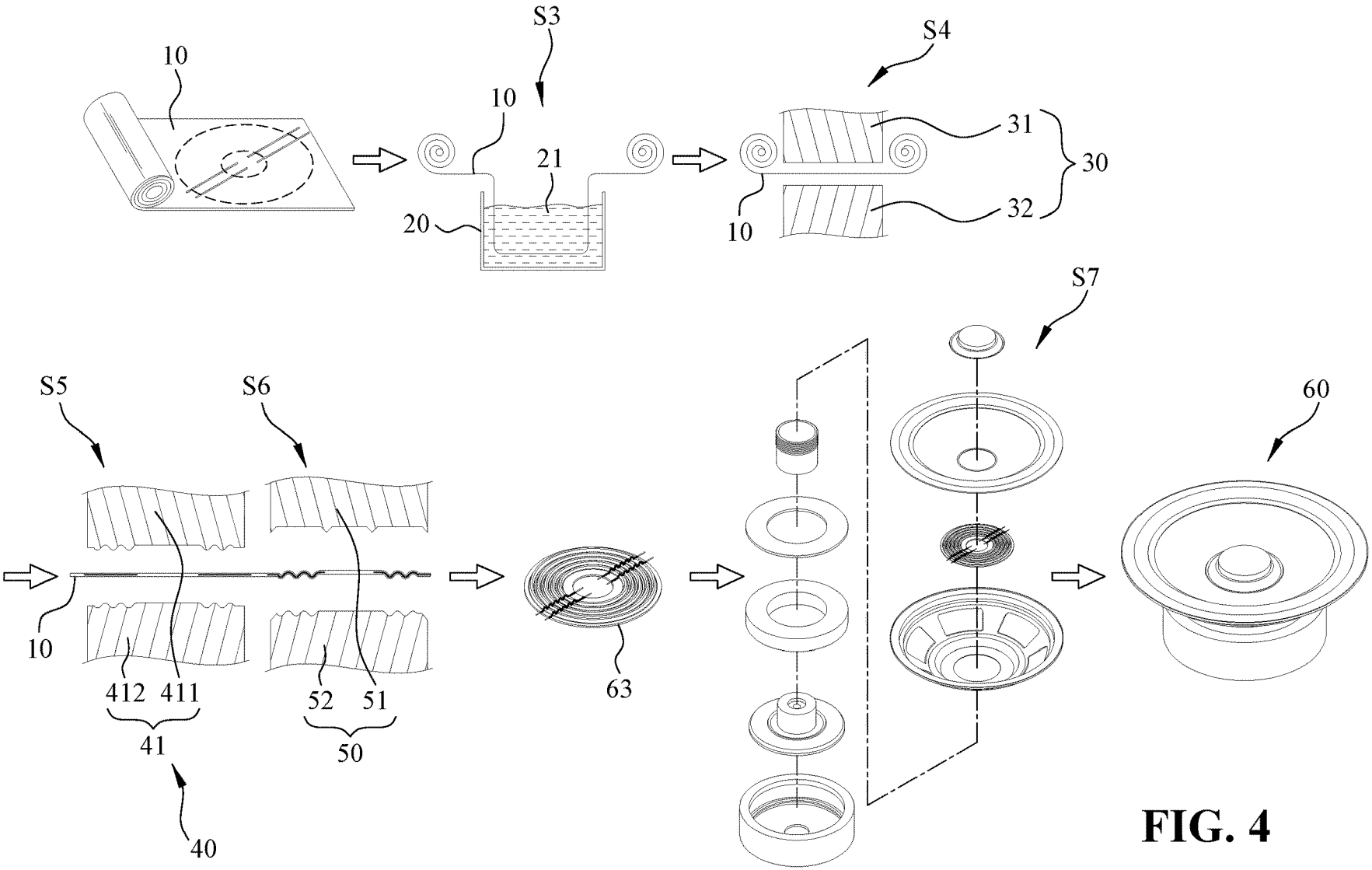
FIG. 4 is a schematic flow diagram of the impregnating step to the assembling step of the first embodiment of the method of the present invention.

In the impregnating step S3, as shown in FIGS. 1 and 4, the base material 10 is impregnated in a resin solution 21 in a resin tank 20, such that the warp yarns 11, the first wires 123, the second wires 133 and the weft yarns 14 adsorb the resin and are adhered with the resin.

In the drying step S4, as shown in FIGS. 1 and 4, a drying device 30 includes an upper baking plate 31 and a lower baking plate 32. By utilizing the temperature of the upper baking plate 31 and the lower baking plate 32, the moisture and volatile substances in the resin on the base material 10 are removed such that the base material 10 is dried. Meanwhile, the resin penetrates into the base material 10 and is adhered onto the warp yarns 11, the first wires 123, the second wires 133 and the weft yarns 14, so as to form a solid resin layer 19 (referring to FIG. 5).

In the forming step S5, as shown in FIGS. 1 and 4, a thermoforming device 40 comprises a forming mold 41 and a heating device (not shown), and the forming mold 41 includes an upper mold 411 and a lower mold 412. When the upper mold 411 and the lower mold 412 fit together and pressurize the base material 10, the heating device is applied with electricity to increase the temperature of the upper mold 411 and the lower mold 412 to 190° C. to 270° C., thereby softening the resin on the base material 10. In addition to destroying the resin structure, the resin also fills up in the gaps, and thus respective parts of the resin are connected with each other to form the final morphology of the solid resin layer 19. Therefore, the resin covers between the warp yarns 11, the first wires 123, the second wires 133 and the weft yarns 14, thereby forming a wire damper 63 on the base material 10 by thermoforming.

Figure 5:
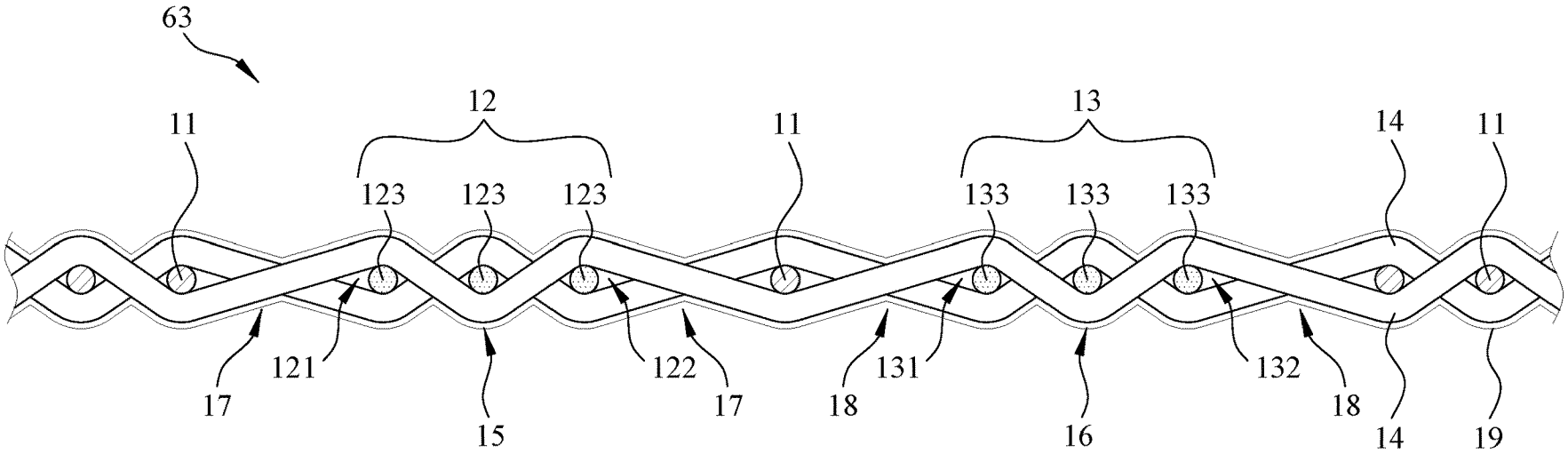
FIG. 5 is a cross-sectional view of the wire damper formed in the forming step of the first embodiment of the method of the present invention.
Figure 6:
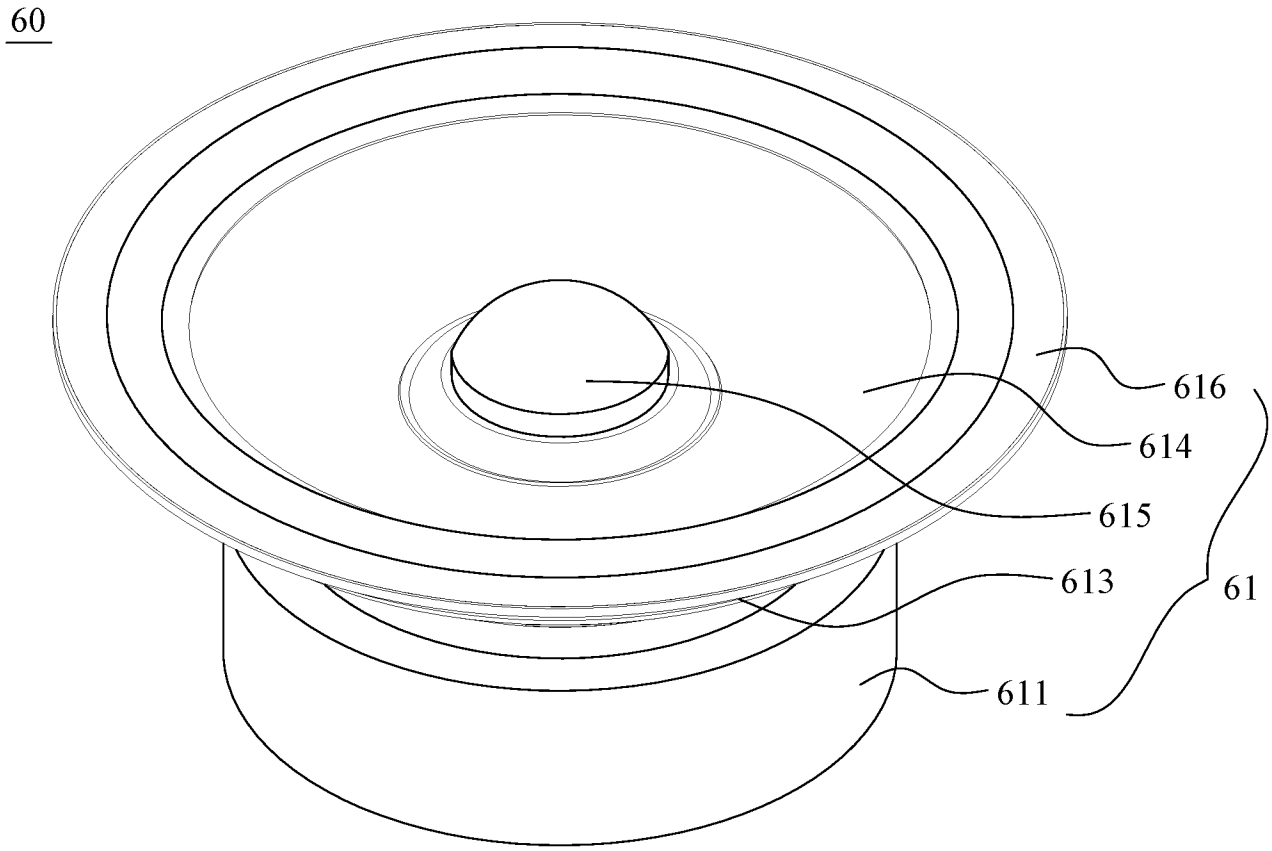
FIG. 6 is a perspective view of the first embodiment of the loudspeaker of the present invention.
Figure 7:
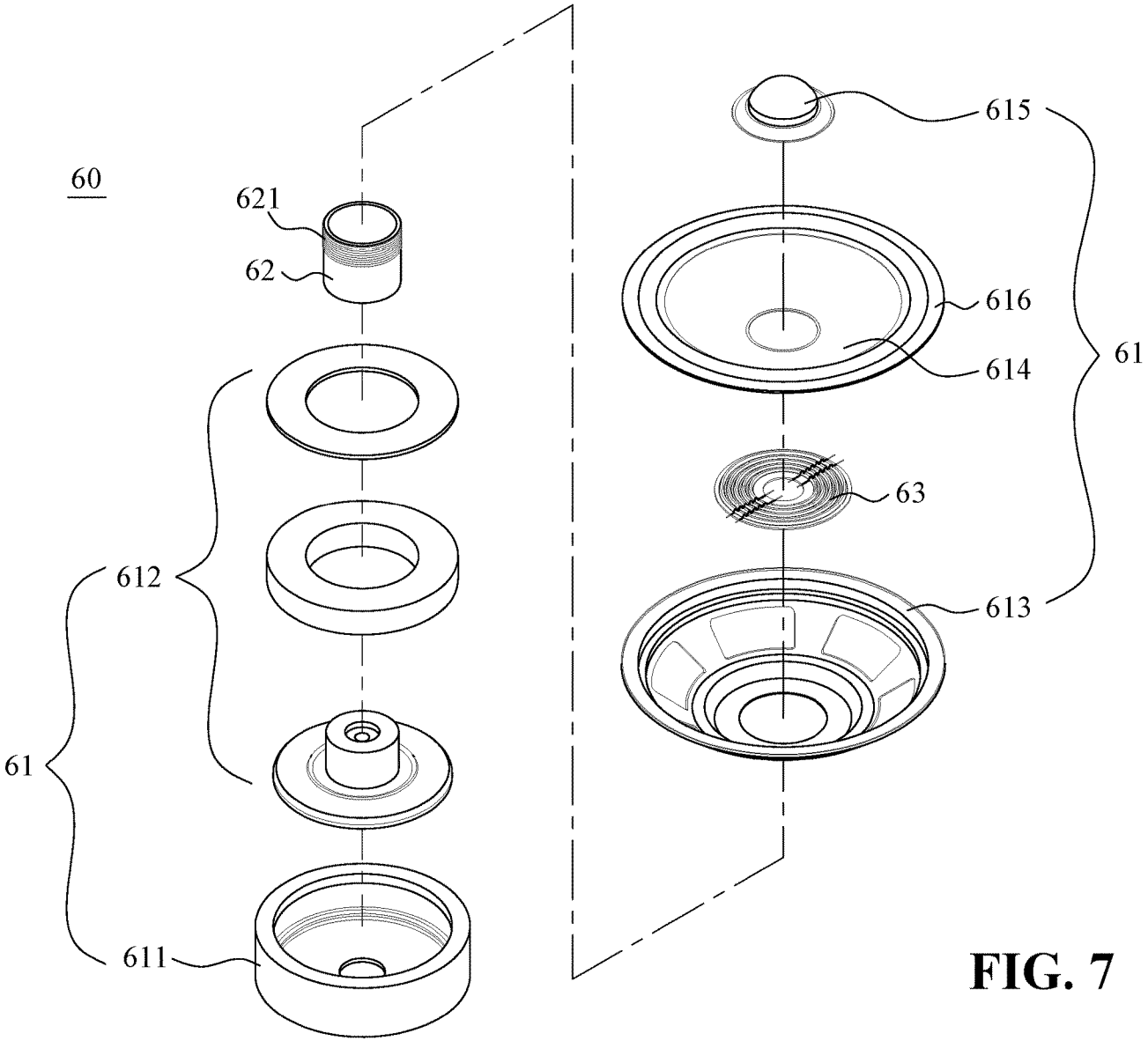
FIG. 7 is an exploded view of the first embodiment of the loudspeaker of the present invention.
Figure 8:
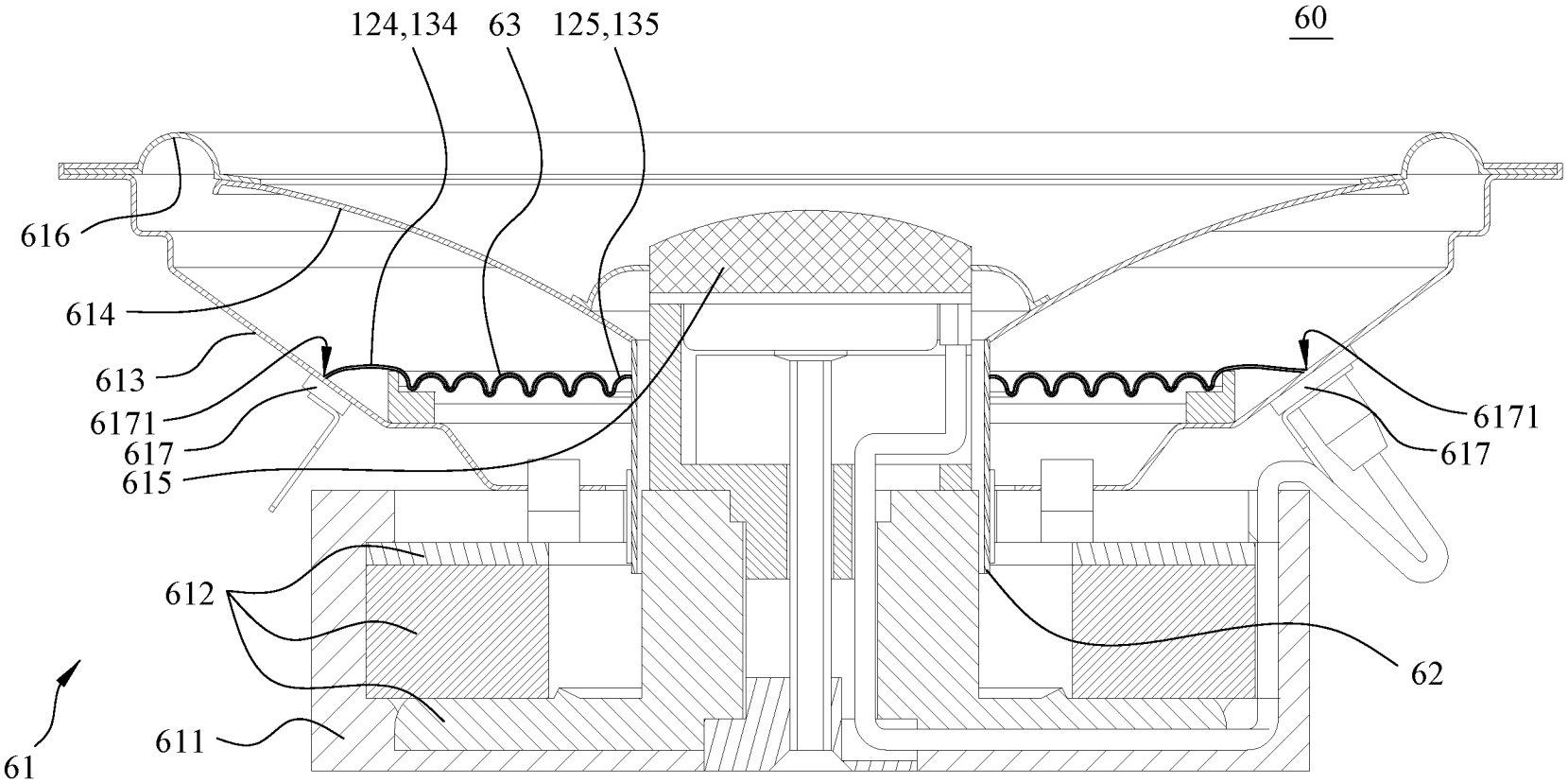
FIG. 8 is a cross-sectional view of the first embodiment of the loudspeaker of the present invention.

As shown in FIG. 5, the wire damper 63 includes the warp yarns 11, the first wires 123, the second wires 133 and the weft yarns 14, and the solid resin layer 19 is formed on the surface of the wire damper 63. A first elastic adjustment area 17 is formed at the weft yarns 14 between the first side 121 of the first wire group 12 and the warp yarn 11 closest to the first side 121 of the first wire group 12. Another first elastic adjustment area 17 is formed at the weft yarns 14 between the second side 122 of the first wire group 12 and the warp yarn 11 closest to the second side 122 of the first wire group 12. A second elastic adjustment area 18 is formed at the weft yarns 14 between the first side 131 of the second wire group 13 and the warp yarn 11 closest to the first side 131 of the second wire group 13. Another second elastic adjustment area 18 is formed at the weft yarns 14 between the second side 132 of the second wire group 13 and the warp yarn 11 closest to the second side 132 of the second wire group 13. Widths of the first elastic adjustment areas 17 and the second elastic adjustment areas 18 are equal to each other, and distances between the remaining warp yarns 11 are less than the width of each of the first elastic adjustment areas 17 and the second elastic adjustment areas 18.

In the cutting step S6, as shown in FIGS. 1 and 4, a cutting device 50 includes an upper cutting tool 51 and a lower cutting tool 52. The wire damper 63 is cut from the base material 10 by the upper cutting tool 51 and the lower cutting tool 52, such that the wire damper 63 is separated from the base material 10.

In the assembling step S7, as shown in FIGS. 1 and 5 to 8, the loudspeaker body 61 includes a base 611, a magnetic circuit device 612, an outer frame 613, a diaphragm 614, a dust cover 615, a surround 616 and a plurality of connecting terminals 617. The magnetic circuit device 612 is disposed on the base 611. A voice coil 62 is movably disposed in the magnetic circuit device 612 and has a coil 621. The outer frame 613 is disposed at upper side of the magnetic circuit device 612. The diaphragm 614 is sleeved at the voice coil 62. The dust cover 615 is disposed at a center hole of the diaphragm 614. The surround 616 is disposed between the top edge of the diaphragm 614 and the outer frame 613. Each connecting terminals 617 is disposed on the outer frame 613 and has a contact point 6171. The wire damper 63 is sleeved at the voice coil 62. The first wire group 12 has a first end 124 and a second end 125. The second wire group 13 has a first end 134 and a second end 135. The first end 124 of the first wire group 12 and the first end 134 of the second wire group 13 are both connected to the contact point 6171 of each connecting terminals 617. The second end 125 of the first wire group 12 and the second end 135 of the second wire group 13 are both connected to the coil 621 of the voice coil 62. Thereby, the loudspeaker body 61, the voice coil 62 and the wire damper 63 are assembled together to form a loudspeaker 60.

Referring to FIGS. 5 to 8, the present invention provides a loudspeaker 60 having a damper with woven wires, including a loudspeaker body 61, a voice coil 62 and a wire damper 63. The structure and connection relationship of the loudspeaker body 61, the voice coil 62 and the wire damper 63 are as described above.

In this way, the present invention utilizes the weft yarns 14 to fix the wires, such that no sewing thread is required at all, the manufacturing steps are reduced, and the first wires 123 and the second wires 133 can be firmly fixed at the optimal position without shifting, which improves the common resonance efficiency of the wire damper 63, the voice coil 62 and the diaphragm 614, and the sound quality of each loudspeaker 60 can be kept consistent.

Furthermore, each first wire 123 and each second wire 133 are harder than each warp yarn 11 and each weft yarn 14, and the elasticity and toughness of each first wire 123 and each second wire 133 are worse than those of each warp yarn 11 and each weft yarn 14, such that the first wire disposing area 15 and the second wire disposing area 16 are harder than other areas of the wire damper 63, and the elasticity and toughness of the first wire disposing area 15 and the second wire disposing area 16 are worse than those of other areas of the wire damper 63. By the first elastic adjustment areas 17, the hardness, elasticity and toughness of the first wire disposing area 15 can be adjusted; and by the second elastic adjustment areas 18, the hardness, elasticity and toughness of the second wire disposing areas 16 can be adjusted. Therefore, the first wire disposing area 15 and the second wire disposing areas 16 become softer, and their elasticity and toughness are increased. Thereby, the hardness, elasticity, and toughness of the combination of the first wire disposing area 15 and the first wires 123 and the combination of the second wire disposing area 16 and the second wires 133 are equivalent to that of other areas of the wire damper 63. Therefore, the wire damper 63 has uniform hardness, elasticity and toughness, thereby having uniform elastic resilience and fatigue resistance, and being not easy to be deformed and brittle, which improves the output sound quality of the loudspeaker 60.

In addition, the first wires 123 are not tightly close to each other but have gaps therebetween, the second wires 133 are not tightly close to each other but have gaps therebetween, and the first wires 123 and the second wires 133 both contact the weft yarns 14. Therefore, the heat generated by the first wires 123 and the second wires 133 can be dissipated through the gaps and the weft yarns 14, and the weft yarns 14 can transfer their absorbed heat to the warp yarns 11 for further dissipation. In this way, the heat generated by the first wires 123 and the second wires 133 is easy to be dissipated without the problem of heat accumulation, such that the first wires 123 and the second wires 133 are not easy to be overheated.

Preferably, each warp yarn 11 is a metal yarn, and each weft yarn 14 is a metal yarn. Since the heat dissipation effect of the metal yarn is very excellent, the present invention can further improve the heat dissipation effect for the first wires 123 and the second wires 133.

Figure 9:
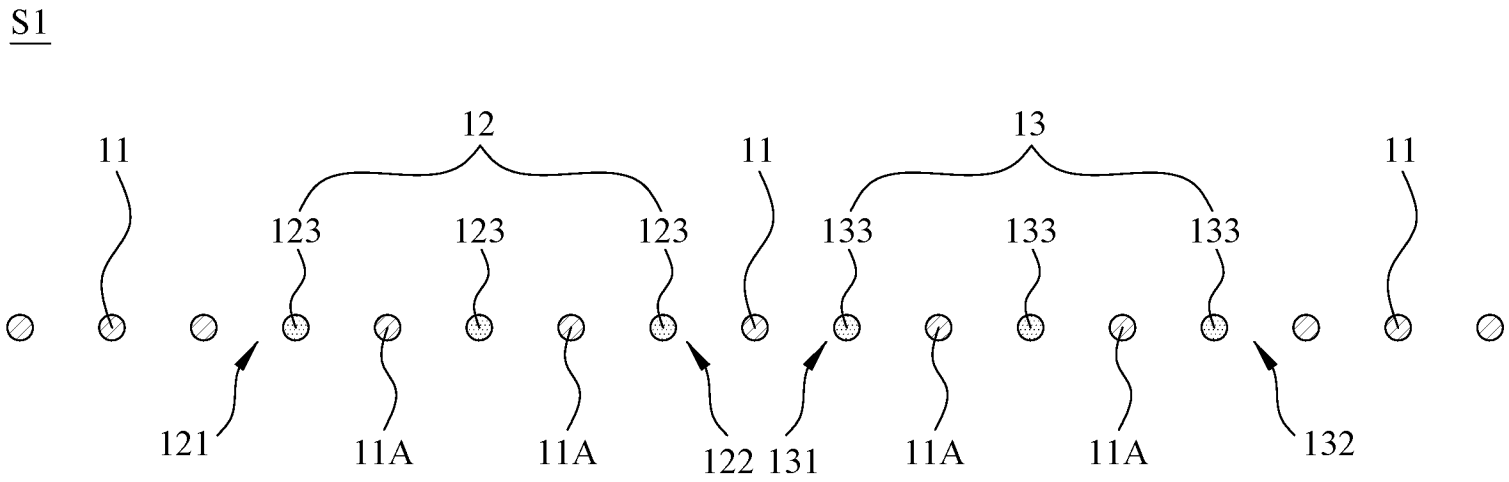
FIG. 9 is a schematic view of the arranging step of the second embodiment of the method of the present invention.
Figure 10:
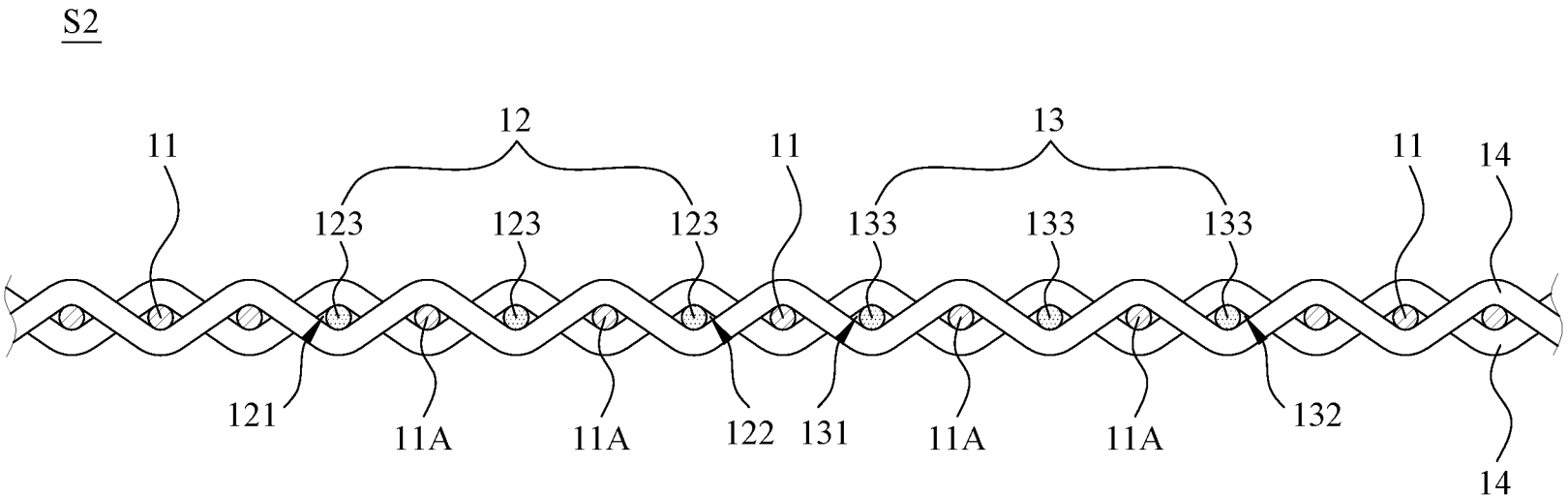
FIG. 10 is a schematic view of the weaving step of the second embodiment of the method of the present invention.
Figure 11:
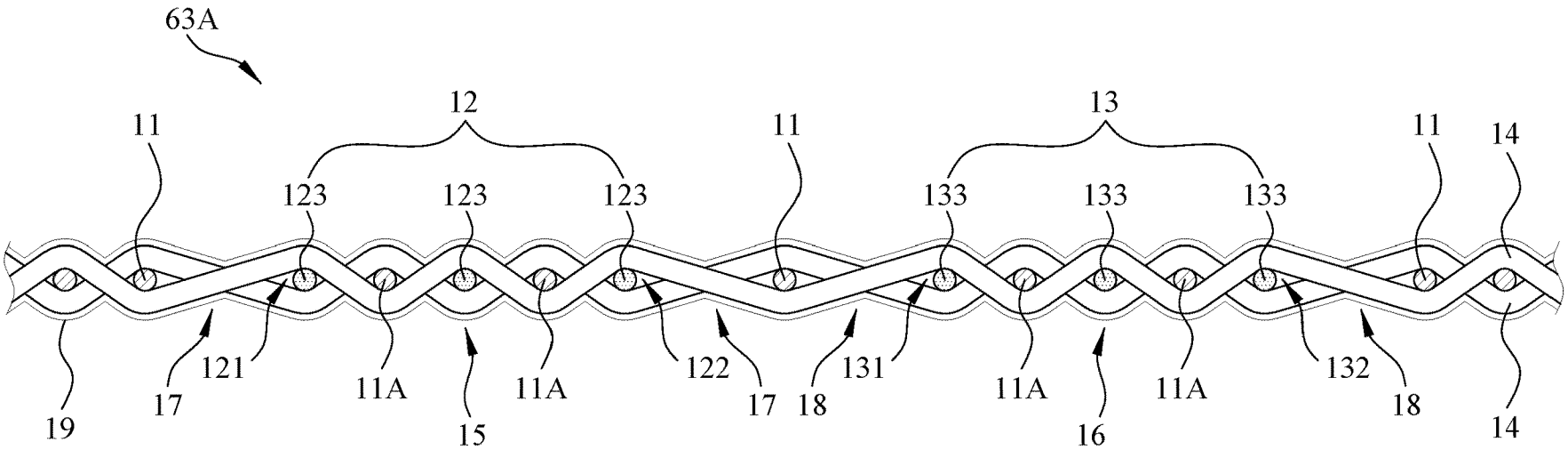
FIG. 11 is a cross-sectional view of the wire damper formed in the forming step of the second embodiment of the method of the present invention.

The second embodiment of the method of the present invention is different from the first embodiment as follows. First, as shown in FIG. 9, in the arranging step S1, a single warp yarn 11A is arranged between each two adjacent first wires 123, and another single warp yarn 11A is disposed between each two adjacent second wires 133. Second, as shown in FIG. 10, in the weaving step S2, the area where the weft yarns 14 are interwoven with the first wires 123 and the single warp yarn 11A between each two adjacent first wires 123 is defined as a first wire disposing area 15, and the area where the weft yarns 14 are interwoven with the second wires 133 and the another single warp yarn 11A between each two adjacent second wires 133 is defined as a second wire disposing area 16. As shown in FIG. 11, after the forming step S5 has been done, the structure of the wire damper 63A of the second embodiment is different from the wire damper 63 of the first embodiment as described above.

In this way, in the second embodiment, the heat of the first wires 123 and the second wires 133 can be further dissipated outward through the single warp yarns 11A therebetween, and the heat dissipation effect is more excellent than the first embodiment. Except for the above differences, all of the remaining technical features of the second embodiment are the same as those of the first embodiment, and can achieve the same effects.

Figure 12:
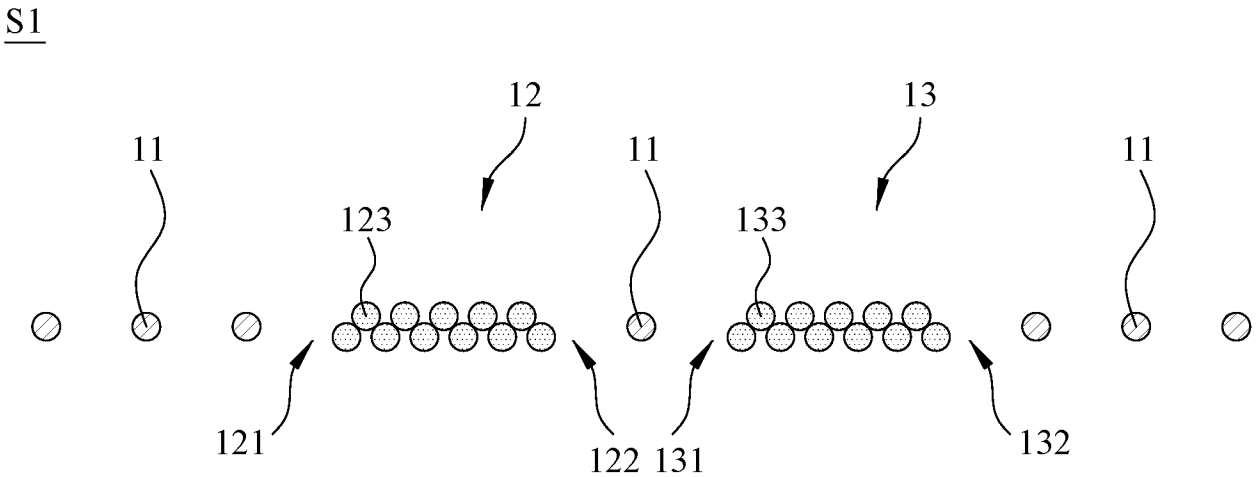
FIG. 12 is a schematic view of the arranging step of the third embodiment of the method of the present invention.
Figure 13:
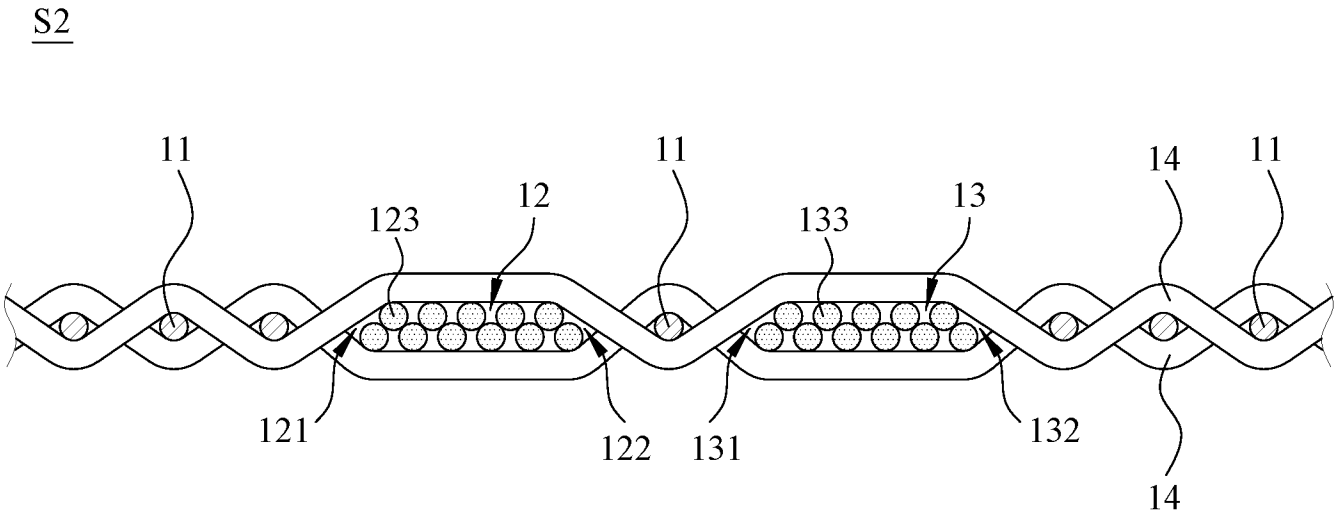
FIG. 13 is a schematic view of the weaving step of the third embodiment of the method of the present invention.
Figure 14:
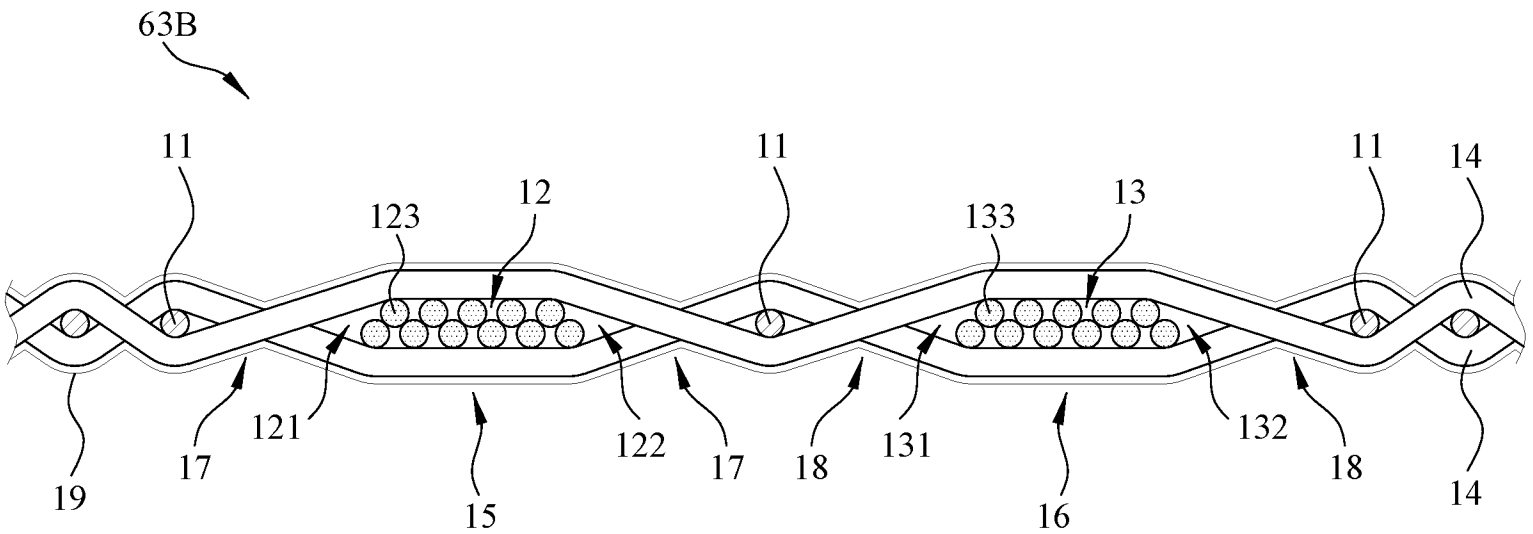
FIG. 14 is a cross-sectional view of the wire damper formed in the forming step of the third embodiment of the method of the present invention.

The third embodiment of the method of the present invention is different from the first embodiment as follows. As shown in FIG. 12, in the arranging step S1, the first wires 123 are interwoven with each other, such that the first wire group 12 is formed as a multifilament wire with a flat cross-section; and the second wires 133 are interwoven with each other, such that the second wire group 13 is formed as a multifilament wire with a flat cross-section. As shown in FIGS. 13 and 14, in the weaving step S2 and after the forming step S5 has been done, the structure of the wire damper 63B of the third embodiment is different from the wire damper 63 of the first embodiment as described above. Except for the above differences, all of the remaining technical features of the third embodiment are the same as those of the first embodiment, and can achieve the same effects.

Figure 15:
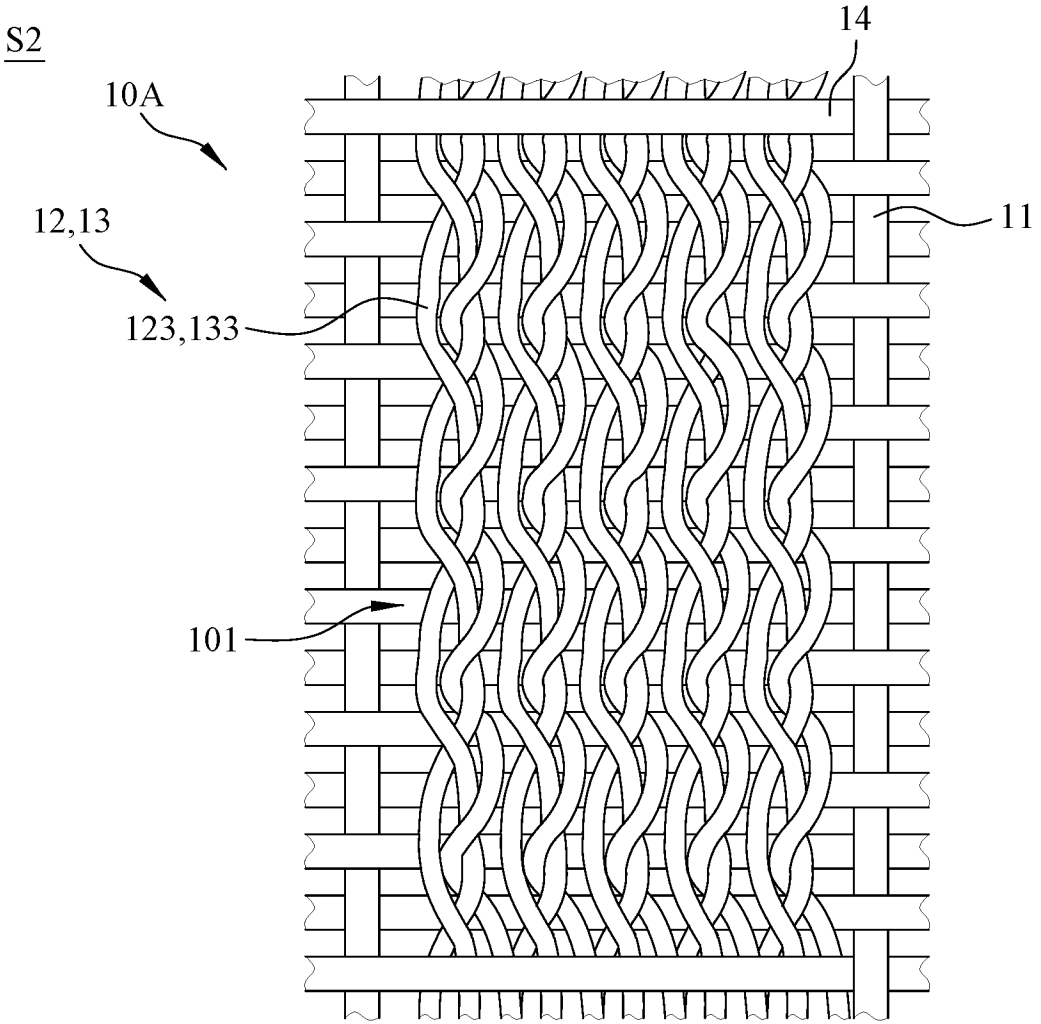
FIG. 15 is a top view of the weaving step of the fourth embodiment of the method of the present invention.
Figure 16:
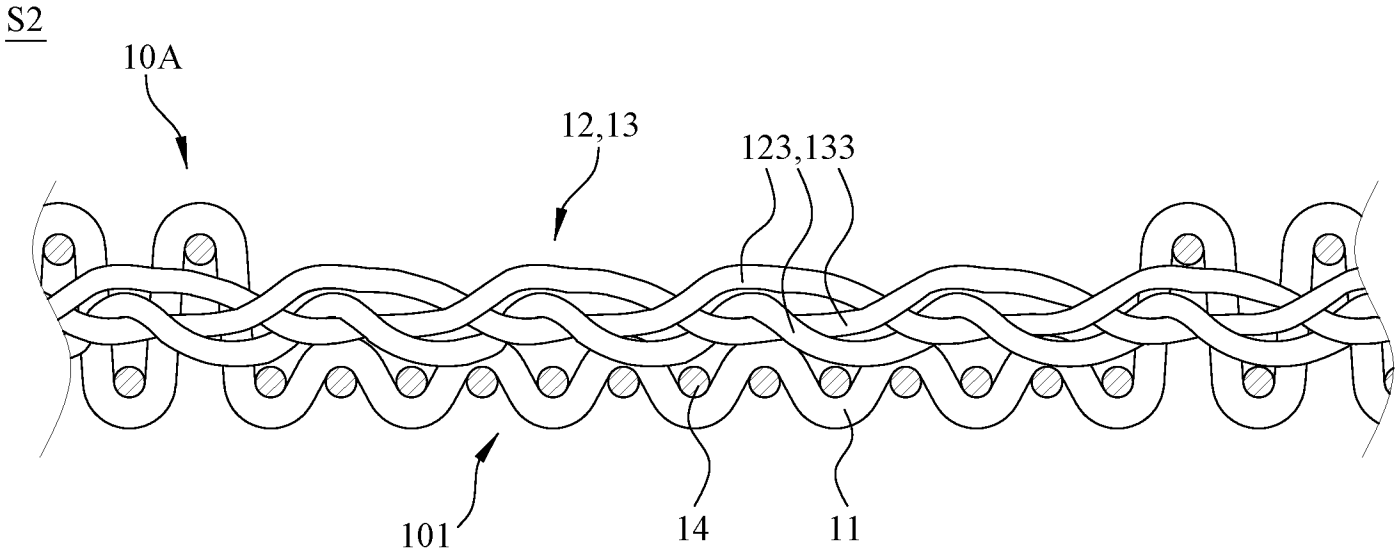
FIG. 16 is a side view of the weaving step of the fourth embodiment of the method of the present invention.
Figure 17:
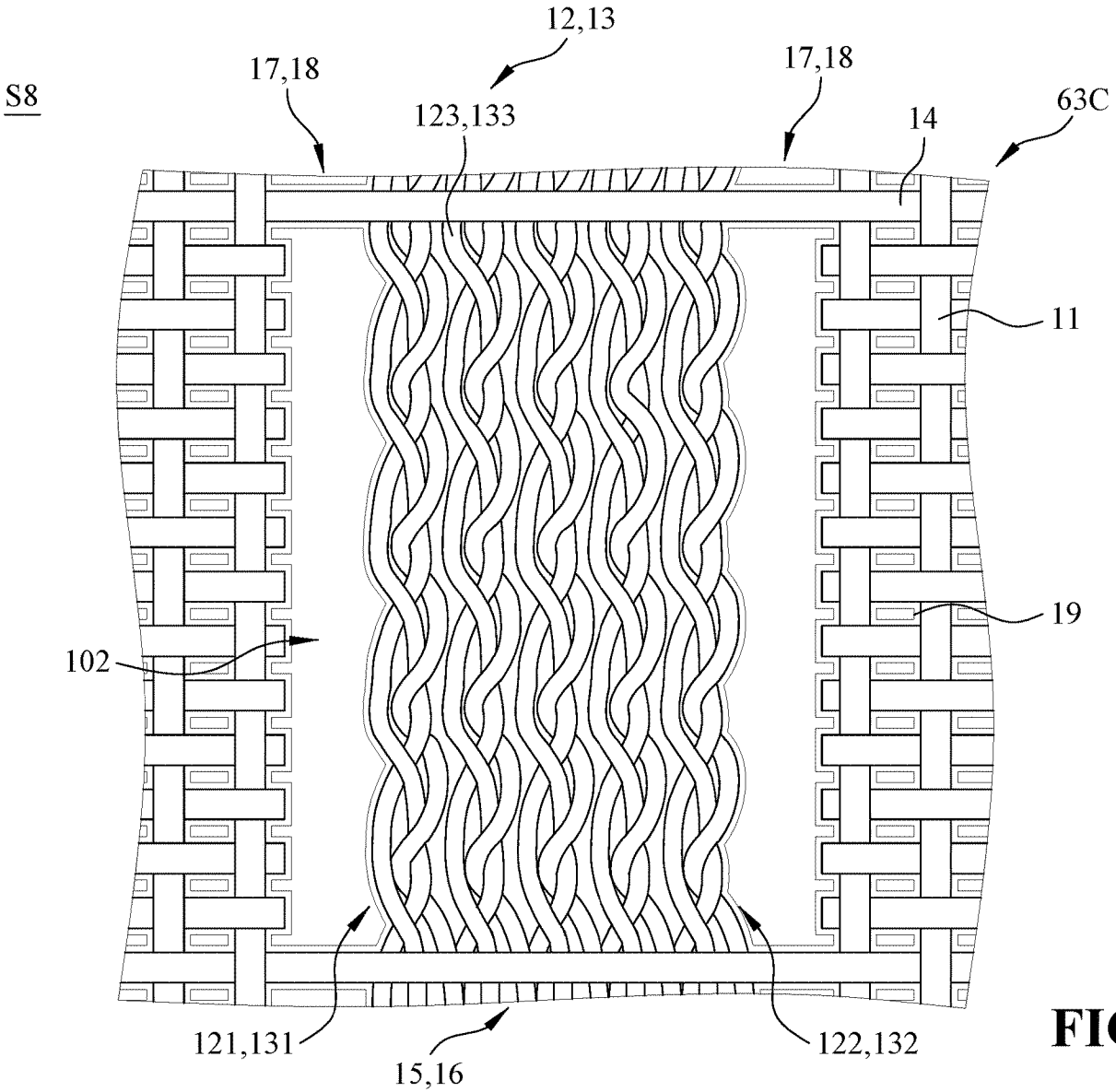
FIG. 17 is a top view of the wire damper have been cut in the cutting step of the fourth embodiment of the method of the present invention.

The fourth embodiment of the method of the present invention is different from the first embodiment as follows. First, as shown in FIG. 15, in the weaving step S2, the weft yarns 14 are interwoven with the warp yarns 11, the first wires 123 and the second wires 133 in an irregular manner, such that the base material 10A is formed with a plurality of trimming areas 101, and a part of the first wire group 12 and a part of the second wire group 13 are exposed at the trimming areas 101. Specifically, in each trimming area 101, the plurality of weft yarns 14 are interwoven with the plurality of warp yarns 11, but not interwoven with the first wire group 12 and the second wire group 13; while at outside of each trimming area 101, all of the weft yarns 14 are interwoven with all of the warp yarns 11 and the first wire group 12 and the second wire group 13. Second, as shown in FIGS. 1 and 16, a trimming step S8 is further included between the cutting step S6 and the assembling step S7. In the trimming step S8, the trimming areas 101 are partially trimmed and removed to form a plurality of hollow portions 102, wherein the plurality of weft yarns 14 around the hollow portions 102 are trimmed off and thus do not pass through the hollow portions 102. Therefore, in the hollow portions 102, none of the weft yarns 14 is interwoven with the part of the first wire group 12 and the part of the second wire group 13, such that the part of the first wire group 12 and the part of the second wire group 13 are allowed to flex freely. After the trimming step S8 has been done, the structure of the wire damper 63C of the fourth embodiment is different from the wire damper 63 of the first embodiment as described above. Except for the above differences, all of the remaining technical features of the fourth embodiment are the same as those of the first embodiment, and can achieve the same effects.

Figure 18:
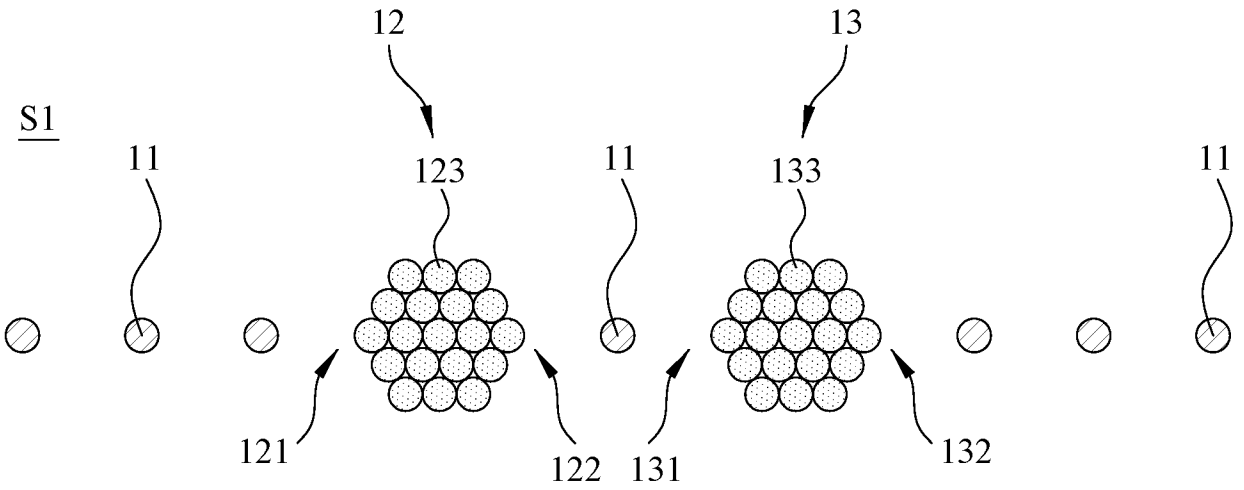
FIG. 18 is a schematic view of the arranging step of the fifth embodiment of the method of the present invention.
Figure 19:
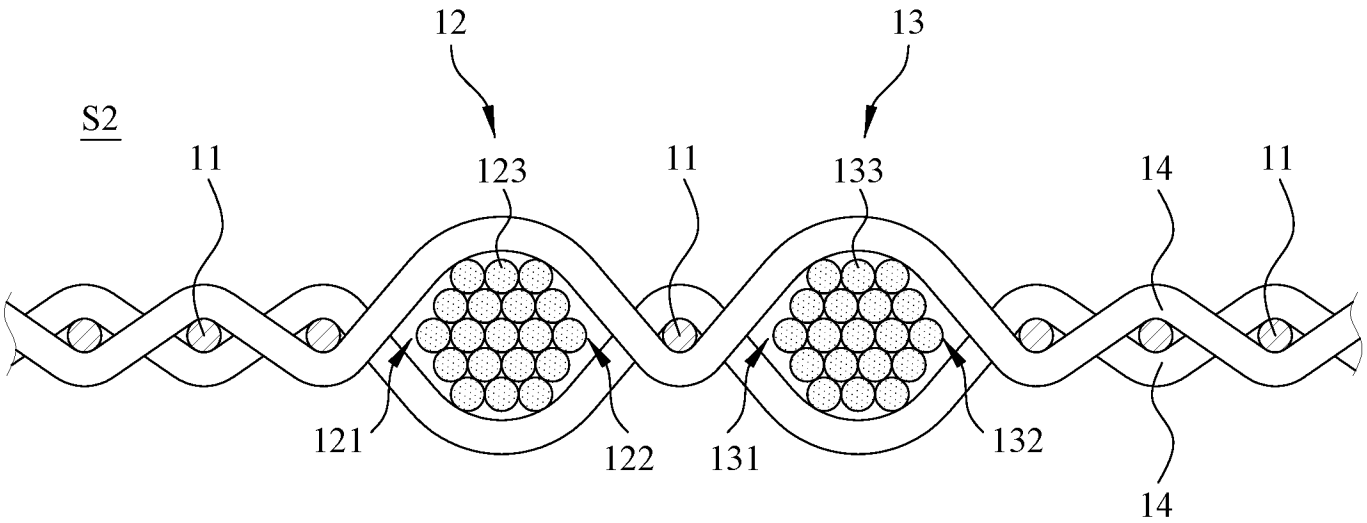
FIG. 19 is a schematic view of the weaving step of the fifth embodiment of the method of the present invention.
Figure 20:
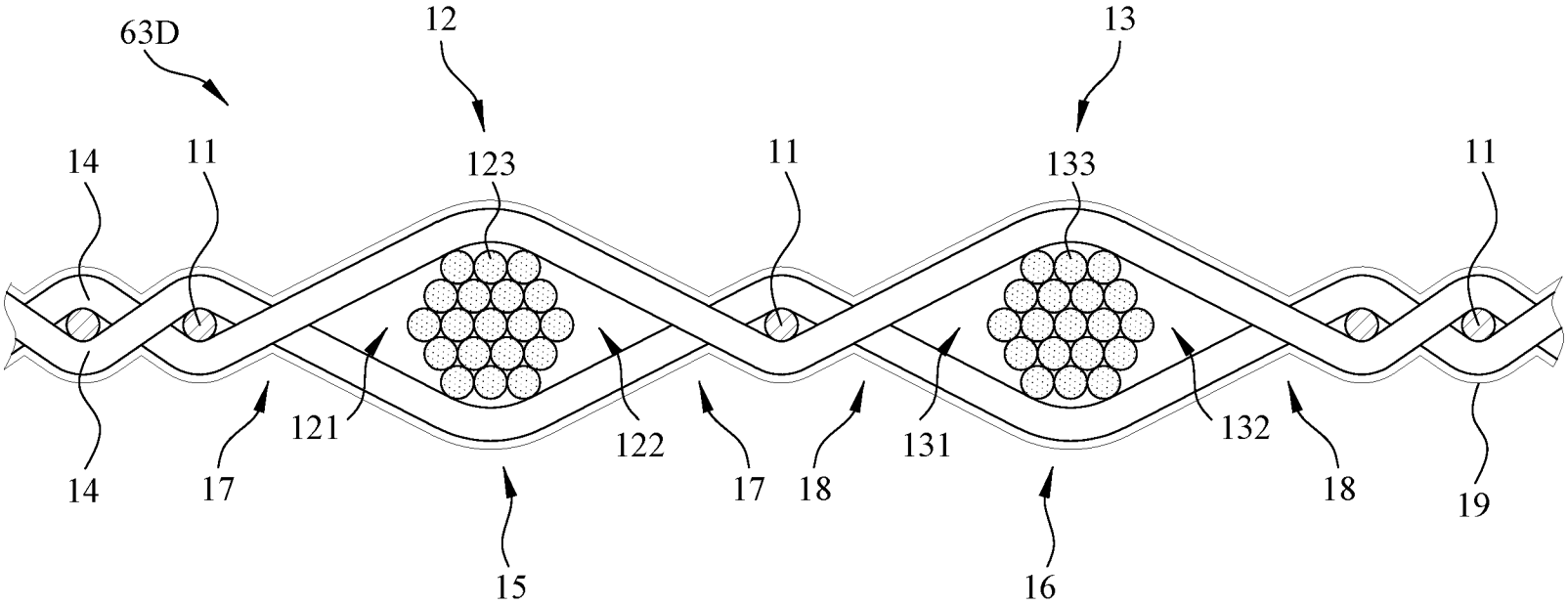
FIG. 20 is a cross-sectional view of the wire damper formed in the forming step of the fifth embodiment of the present invention.

The fifth embodiment of the method of the present invention is different from the first embodiment as follows. As shown in FIG. 18, in the arranging step S1, the first wires 123 are twisted, such that the first wire group 12 is formed as a multifilament wire with a circular cross-section; and the second wires 133 are twisted, such that the second wire group 13 is formed as a multifilament wire with a circular cross-section. As shown in FIGS. 19 and 20, in the weaving step S2 and after the forming step S5 has been done, the structure of the wire damper 63D of the fifth embodiment is different from the wire damper 63 of the first embodiment as described above.

The mentioned above are only preferred embodiments for explaining the present invention but intend to limit the present invention in any forms, so that any modifications or verification relating to the present invention made in the same spirit of the invention should still be included in the scope of the invention as intended to be claimed.

What is claimed is:

1. A method for manufacturing a loudspeaker, comprising the following steps:

an arranging step in which a plurality of warp yarns and a plurality of wires are arranged at intervals, the warp yarns and the wires extend straight and are parallel to each other, each of the wires is a monofilament wire, the wires are grouped as at least one wire group, and both sides of the at least one wire group are respectively defined as a first side and a second side of the at least one wire group;

a weaving step in which a plurality of weft yarns are arranged at intervals and interwoven with the warp yarns and the wires to form a base material by weaving, the weft yarns extend straight and are perpendicular to the warp yarns and the wires, and an area where the weft yarns are interwoven with the wires is defined as a wire disposing area;

an impregnating step in which the base material is impregnated in a resin solution;

a drying step in which the base material is dried to form a solid resin layer on the base material;

a forming step in which a wire damper is formed on the base material by thermoforming, the wire damper includes the warp yarns, the wires and the weft yarns, and the solid resin layer is formed on a surface of the wire damper; an elastic adjustment area is formed at the weft yarns between the first side of the at least one wire group and the warp yarn closest to the first side of the at least one wire group; another elastic adjustment area is formed at the weft yarns between the second side of the at least one wire group and the warp yarn closest to the second side of the at least one wire group; and widths of the elastic adjustment area and the another elastic adjustment area are equal to each other, and distances between the remaining warp yarns are less than the width of each of the elastic adjustment area and the another elastic adjustment area;

a cutting step in which the wire damper is cut from the base material; and an assembling step in which a voice coil is movably disposed in a loudspeaker body, the wire damper is sleeved at the voice coil, and the at least one wire group is connected to the voice coil to assemble the loudspeaker;

wherein every two adjacent wires are separated by a gap, the at least one wire group is separated respectively by a gap with the warp yarn closest to the first side and the warp yarn closest to the second side, and each weft yarn interweaves with the wires and the warp yarns by passing through every gap between two adjacent wires and every gap between the at least one wire group and the warp yarn closest to each of the first and second sides.

2. The method according to claim 1, wherein in the arranging step, the wires include a plurality of first wires and a plurality of second wires; the first wires are arranged side by side are grouped as a first wire group, and both sides of the first wire group are respectively defined as a first side and a second side of the first wire group; the second wires are arranged side by side are grouped as a second wire group, and both sides of the second wire group are respectively defined as a first side and a second side of the second wire group; and at least one of the warp yarns is arranged between the second side of the first wire group and the first side of the second wire group; wherein in the weaving step, an area where the weft yarns are interwoven with the first wires is defined as a first wire disposing area, and an area where the weft yarns are interwoven with the second wires is defined as a second wire disposing area; wherein in the forming step, a first elastic adjustment area is formed at the weft yarns between the first side of the first wire group and the warp yarn closest to the first side of the first wire group; another first elastic adjustment area is formed at the weft yarns between the second side of the first wire group and the warp yarn closest to the second side of the first wire group; a second elastic adjustment area is formed at the weft yarns between the first side of the second wire group and the warp yarn closest to the first side of the second wire group; another second elastic adjustment area is formed at the weft yarns between the second side of the second wire group and the warp yarn closest to the second side of the second wire group; and widths of the first elastic adjustment area, the another first elastic adjustment area, the second elastic adjustment area and the another second elastic adjustment area are equal to each other, and distances between the remaining warp yarns are less than the width of each of the first elastic adjustment area, the another first elastic adjustment area, the second elastic adjustment area and the another second elastic adjustment area; and wherein in the assembling step, the first wire group and the second wire group are connected to the voice coil, respectively.

3. A loudspeaker, comprising:

a loudspeaker body;

a voice coil, which is movably disposed in the loudspeaker body; and a wire damper, which is sleeved at the voice coil and includes a plurality of warp yarns, a plurality of wires and a plurality of weft yarns, a solid resin layer is formed on a surface of the wire damper, the warp yarns and the wires are arranged at intervals, the warp yarns and the wires extend straight and are parallel to each other, each of the wires is a monofilament wire, the wires are grouped as at least one wire group, both sides of the at least one wire group are respectively defined as a first side and a second side of the at least one wire group, the weft yarns are arranged at intervals and interwoven with the warp yarns and the wires, the weft yarns extend straight and are perpendicular to the warp yarns and the wires, an area where the weft yarns are interwoven with the wires is defined as a wire disposing area, an elastic adjustment area is formed at the weft yarns between the first side of the at least one wire group and the warp yarn closest to the first side of the at least one wire group, another elastic adjustment area is formed at the weft yarns between the second side of the at least one wire group and the warp yarn closest to the second side of the at least one wire group, widths of the elastic adjustment area and the another elastic adjustment area are equal to each other, distances between the remaining warp yarns are less than the width of each of the elastic adjustment area and the another elastic adjustment area, and the at least one wire group is connected to the voice coil;

wherein every two adjacent wires are separated by a gap, the at least one wire group is separated respectively by a gap with the warp yarn closest to the first side and the warp yarn closest to the second side, and each weft yarn interweaves with the wires and the warp yarns by passing through every gap between two adjacent wires and every gap between the at least one wire group and the warp yarn closest to each of the first and second sides.

4. The loudspeaker according to claim 3, wherein the wires include a plurality of first wires and a plurality of second wires; the first wires are arranged side by side and grouped as a first wire group, and both sides of the first wire group are respectively defined as a first side and a second side of the first wire group; the second wires are arranged side by side and grouped as a second wire group, and both sides of the second wire group are respectively defined as a first side and a second side of the second wire group; and at least one of the warp yarns is arranged between the second side of the first wire group and the first side of the second wire group; wherein an area where the weft yarns are interwoven with the first wires is defined as a first wire disposing area, and an area where the weft yarns are interwoven with the second wires is defined as a second wire disposing area; wherein a first elastic adjustment area is formed at the weft yarns between the first side of the first wire group and the warp yarn closest to the first side of the first wire group; another first elastic adjustment area is formed at the weft yarns between the second side of the first wire group and the warp yarn closest to the second side of the first wire group; a second elastic adjustment area is formed at the weft yarns between the first side of the second wire group and the warp yarn closest to the first side of the second wire group; another second elastic adjustment area is formed at the weft yarns between the second side of the second wire group and the warp yarn closest to the second side of the second wire group; and widths of the first elastic adjustment area, the another first elastic adjustment area, the second elastic adjustment area and the another second elastic adjustment area are equal to each other, and distances between the remaining warp yarns are less than the width of each of the first elastic adjustment area, the another first elastic adjustment area, the second elastic adjustment area and the another second elastic adjustment area; and wherein the first wire group and the second wire group are connected to the voice coil, respectively.

* * * * *